US008424614B2

(12) United States Patent
Henriksson

(10) Patent No.: US 8,424,614 B2
(45) Date of Patent: Apr. 23, 2013

(54) HYDRAULIC HAMMER

(75) Inventor: Stig Roland Henriksson, Nacka (SE)

(73) Assignee: Atlas Copco Construction Tools AB, Nacka (SE)

( * ) Notice: Subject to any disclaimer, the term of this patent is extended or adjusted under 35 U.S.C. 154(b) by 1433 days.

(21) Appl. No.: 10/592,601

(22) PCT Filed: Mar. 7, 2005

(86) PCT No.: PCT/SE2005/000327

§ 371 (c)(1),
(2), (4) Date: Nov. 21, 2006

(87) PCT Pub. No.: WO2005/087445

PCT Pub. Date: Sep. 22, 2005

(65) Prior Publication Data

US 2008/0135270 A1 Jun. 12, 2008

(30) Foreign Application Priority Data

Mar. 12, 2004 (SE) ..... 0400616

(51) Int. Cl.
*B23Q 5/06* (2006.01)

(52) U.S. Cl.
USPC ..... 173/13; 173/206

(58) Field of Classification Search ..... 173/13, 173/206; 91/290, 300
See application file for complete search history.

(56) References Cited

U.S. PATENT DOCUMENTS

| | | | | | |
|---|---|---|---|---|---|
| 3,908,767 | A | | 9/1975 | Klemm | |
| 4,034,817 | A | * | 7/1977 | Okada | 173/207 |
| 4,349,075 | A | * | 9/1982 | Henriksson | 173/208 |
| 4,413,687 | A | * | 11/1983 | Eklof | 173/207 |
| 4,646,854 | A | | 3/1987 | Arndt et al. | |
| 4,676,323 | A | * | 6/1987 | Henriksson | 173/200 |
| 4,951,757 | A | * | 8/1990 | Hamada et al. | 173/115 |
| 5,038,668 | A | * | 8/1991 | Arndt et al. | 91/290 |
| 5,279,120 | A | * | 1/1994 | Sasaki | 60/413 |
| 5,520,254 | A | | 5/1996 | Weber | |
| 5,549,031 | A | * | 8/1996 | Giordano | 91/284 |

FOREIGN PATENT DOCUMENTS

| | | | |
|---|---|---|---|
| EP | 0335994 | A1 | 10/1989 |
| GB | 1478435 | A | 6/1977 |
| GB | 1478435 | A | 6/1997 |

* cited by examiner

*Primary Examiner* — M. Alexandra Elve
*Assistant Examiner* — Nathaniel Chukwurah
(74) *Attorney, Agent, or Firm* — Holtz, Holtz, Goodman & Chick, P.C.

(57) ABSTRACT

A hydraulic hammer comprising a housing (10) with a longitudinal bore (12), cylinder sleeve (14) supported in the bore (12) a rear and cover (16) closing the bore (12), and a hammer piston (15) reciprocally powered in the cylinder sleeve (14) for delivering blows to a working implement inserted in the guide sleeve (20) mounted at the front end of the bore (12). The hydraulic hammer also comprises a distribution valve (31), for directing pressure fluid to the hammer piston (15), communicating the pressure fluid source and the cylinder sleeve (14). The valve (31) comprises both a clearance seal means (44) and a seat seal (45, 46) for improved tightness.

7 Claims, 1 Drawing Sheet

HYDRAULIC HAMMER

This application is a U.S. National Phase Application under 35 USC 371 of International Application PCT/SE2005/000327 filed Mar. 7, 2005.

FIELD OF THE INVENTION

The invention relates to hydraulic hammer of the type including a housing with a cylinder bore and a retaining means for a working implement, a hammer piston guided in the cylinder bore, and a control valve for directing pressure fluid to the hammer piston for making the same reciprocate in the cylinder bore and deliver hammer blows to the working implement.

BACKGROUND OF THE INVENTION

Hydraulic hammers of this type are previously known, for instance through GB 1478435. In this publication there is described a hammer or percussive device in which the control valve is formed as a sleeve element surrounding the hammer piston. This large diameter control valve is disadvantageous in that it is relatively heavy, which means that the valve action is relatively slow and the hammer frequency is low. The relatively large valve diameter also means long seal clearances causing a low degree of valve tightness.

In EP 335 994 there is described a hydraulic hammer having a spool type control valve. Due to a relatively small diameter this valve can be lighter and tighter. However, this valve also relies on a clearance seal to cut off the communication with one of the cylinder ports. Clearance seals are always dependent on tolerance deviations, and in order to ensure a free running valve the tolerances have to be on the large side. So, despite a relatively small diameter the clearance leakage in this type of valves is a problem and causes a limitation of the hammer efficiency.

SUMMARY OF THE INVENTION

The main object of the invention is to create a hydraulic hammer having a distribution valve with an improved tightness for a more efficient hammer action.

Further objects and advantages of the invention will appear from the following specification and claims.

A preferred embodiment of the invention is described below with reference to the accompanying drawing.

DETAILED DESCRIPTION

Figure 1:
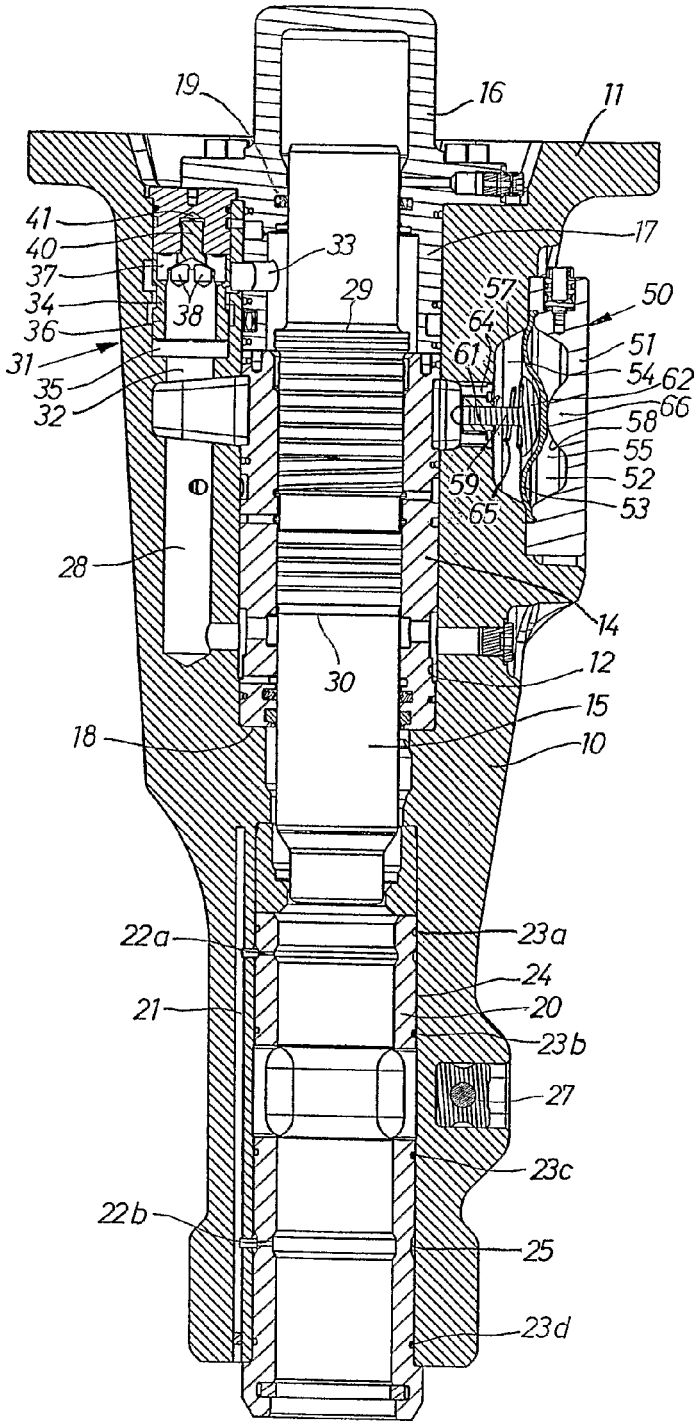
FIG. 1 shows a longitudinal section through a hydraulic hammer according to the invention.
Figure 2:
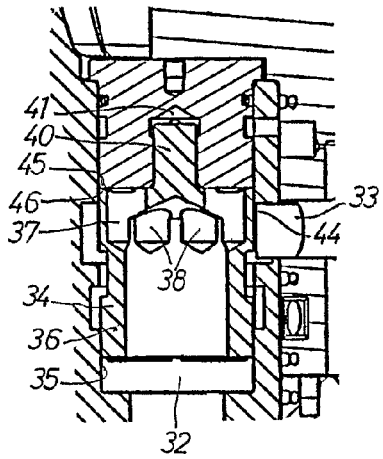
FIG. 2 shows on a larger scale a section through the distribution valve of the breaking hammer in FIG. 1.

The hydraulic hammer illustrated in the drawing figures comprises a housing 10 formed with a rear mounting shoulder 11 for attachment to a mechanical carrier like an excavator arm. The housing 10 is provided with a longitudinal through bore 12 which in its rear part supports a cylinder sleeve 14 for sealingly guide a hammer piston 15. At the rear end of the housing 10 there is bolted on an end cover 16 which forms an end closure for the bore 12. This end cover 16 is formed as a one piece member with a tube shaped neck portion 17 which extends into the bore 12 and contacts the rear end of the cylinder sleeve 14. The latter is clamped in its proper position in the bore 12 between the end cover neck portion 17 and a shoulder 18 in the bore 12. The neck portion 17 also forms a guide means for the hammer piston 15 and carries a seal ring 19 for co-operation with the rear end of the hammer piston 15.

Figure 3:
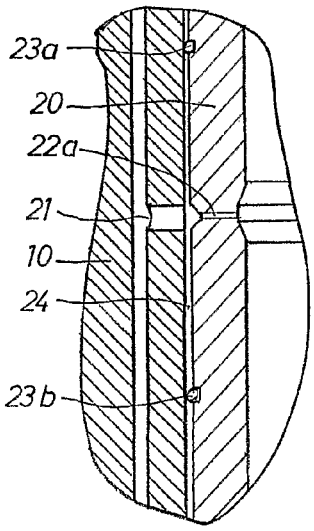
FIG. 3 shows on a larger scale a fractional section through the implement sleeve arrangement of the breaking hammer in FIG. 1.

In its front part the bore 12 carries a working implement guide sleeve 20 which is intended to receive the rear end of a working implement (not shown). For lubricating the sleeve 20 on its inside there is provided a lubricant supply passage 21 in the housing 10 which via radial openings 22 *a,b* in the guide sleeve 20 communicates with the inside of the guide sleeve 20. Moreover, the guide sleeve 20 is provided with four O-rings 23 *a-d* on its outside the purposes of which are two, namely via frictional engagement with the bore 12 retain the sleeve 20 in the bore 12, and to seal off between them two annular compartments 24,25. The radial openings 22 *a,b* in the guide sleeve 20 are located between the O-rings 23 *a,b* and 23 *c,d*, respectively, such that lubricant has to pass through the compartments 24,25 to reach the radial openings 22 *a,b* and the guide sleeve 20 inside. See FIG. 3. Accordingly, the compartments 24,25 are filled with lubricant (grease), and due to the relative axial extension of the compartments 24,25 lubricant is spread over a substantial part of the outside surface of the guide sleeve 20, thereby, preventing seizure of the guide sleeve 20 relative to the bore 12.

The housing 10 has a pressure fluid inlet passage 28 for supplying motive pressure fluid to the cylinder sleeve 14 so as to drive the hammer piston 15 in its reciprocating movement for delivering blows to a working implement inserted in the guide sleeve 20. The piston 15 has two oppositely facing drive surfaces 29,30, whereof the lower surface 30 is continuously connected to the pressure fluid source, whereas the upper surface 29 is intermittently pressurised via a pressure fluid distribution valve 31. The distribution valve 31 has a fluid inlet 32 communicating with the pressure fluid inlet passage 28, and a fluid outlet 33 communicating with the upper drive surface 29 of the hammer piston 15. Moreover, the distribution valve 31 comprises a valve bore 35 and a valve element 34 sealingly guided in the bore 35. The valve element 34 consists of a tubular guide portion 36 guided in the bore 35, and an end wall 37. In the end wall 37 there are through openings 38 for connecting the inside of the guide portion 36 and the fluid inlet 32 with the outer surface of the end wall 37. The end wall 37 is provided with a reduced diameter activation portion 40 which extends co-axially in a direction opposite the guide portion 36 and is received in an intermittently pressurised activation bore 41.

The end wall 37 has a slightly larger cross section than the guide portion 36, and since the valve element 34 is open ended the fluid pressure will act constantly both on the surface area formed by the guide portion 36 and via the openings 38 on the outer surface of the end wall 37. In the position where the activation bore 41 is connected to tank, i.e. no pressure acting on the activation portion 40, the remaining part of the end wall 37 is smaller than the guide portion area resulting in a closing force on the valve element 34. When instead the activation bore 41 is pressurised the total area of the end wall 37 plus the activation portion 40 will generate a force that will dominate over the force generated by the pressure acting on the guide portion area. This means that the valve element 34 is shifted to its open position. (Not shown).

The valve element 34 is provided to control the communication between the inlet 32 and the outlet 33, and for that purpose the valve element 34 is formed with a double seal function, namely both a clearance seal and a seat seal. The seat seal is the primary seal and is formed by an annular seat 45 at the end of the bore 35 in co-operation with an annular contact surface 46 on the end wall 37. The clearance seal is the secondary seal and is formed by a circumferential surface 44 of the end wall 37 co-operates with the valve bore 35 as illustrated in the closed position of the valve shown in FIG. 1. By a combined clearance seal and seat seal as described above there is obtained a high degree of valve tightness and, hence, a high efficiency of the hammer.

The hammer shown in the drawing also comprises a pressure peak absorbing accumulator 50 which is partly formed by the hammer housing 10 and partly by a cover 51 attached to the housing 10. The accumulator 50 comprises an expansion chamber 52 which in a conventional way is divided by a flexible membrane 53 into a pressure fluid compartment 54 and a gas cushion compartment 55. The expansion chamber 52 is defined by an inner wall 57 and an outer wall 58, wherein the outer wall 58 is formed by the cover 51.

There is also provided a movable membrane support 59 consisting of a stem portion 61 and a membrane engaging head 62. The latter is located inside the pressure fluid compartment 54, whereas the stem portion 61 is displacebly guided in a bore in the inner wall 57. Openings 64 are provided in parallel with the stem portion 61 to communicate pressure fluid into the expansion chamber 52, and the head 62 of the membrane support 59 is arranged to cover these openings 64 at low pressure levels when the membrane 53 is pressed against the inner wall 57. A spring 65 is provided to exert a bias force on the membrane support 59 in the direction of the membrane 53. In order to limit the length of the guiding stem portion 61 there is provided a stop means in the form of a bulge shaped projection 66 on the outer expansion chamber wall 58. This projection 66 is formed integrally as a one piece member with the cover 51. This movement limiting arrangement for the membrane support 59 is simple in design as it contain no extra elements.

The embodiments of the invention are not limited to the above described example but can be freely varied within the scope of the claims.

The invention claimed is:

1. A hydraulic hammer comprising:

a housing with a cylinder bore and a guide sleeve for a working implement, a reciprocating hammer piston reciprocated in the cylinder bore, and a distribution valve for directing pressure fluid to the hammer piston, wherein said distribution valve comprises:

a valve bore with a pressure fluid inlet communicating with the pressure fluid source and a pressure fluid outlet communicating with one drive side of the hammer piston, and a valve element sealingly guided in the valve bore for controlling a flow of pressure fluid between said inlet and said outlet, wherein said distribution valve includes:

a primary seal means including an axially facing valve seat in said valve bore and a contact surface on said valve element for sealing contact with said valve seat, and a secondary seal means including a cylindrical envelope surface on said valve element for clearance sealing relative to said valve bore, and wherein said primary and secondary seal means are arranged in series to seal off pressure fluid communication between said inlet and said outlet.

2. The hydraulic hammer according to claim 1, wherein said valve element comprises a tubular guide portion and a transverse end wall, said envelope surface is formed on a periphery of said end wall, and said contact surface is located on said end wall.

3. The hydraulic hammer according to claim 1, wherein said end wall has at least one through opening for communicating pressure fluid from inside said tubular guide portion up to said primary and secondary seal means, and said contact surface is annular in shape and surrounds said openings.

4. The hydraulic hammer according to claim 2, wherein said valve element comprises a reduced diameter activation portion which extends concentrically from said end wall in a direction opposite said tubular guide portion, and said activation portion is sealingly guided in an intermittently pressurized activation bore.

5. The hydraulic hammer according to claim 2, wherein said end wall has at least one through opening for communicating pressure fluid from inside said tubular guide portion up to said primary and secondary seal means, and said contact surface is annular in shape and surrounds said openings.

6. The hydraulic hammer according to claim 3, wherein said valve element comprises a reduced diameter activation portion which extends concentrically from said end wall in a direction opposite said tubular guide portion, and said activation portion is sealingly guided in an intermittently pressurized activation bore.

7. The hydraulic hammer according to claim 5, wherein said valve element comprises a reduced diameter activation portion which extends concentrically from said end wall in a direction opposite said tubular guide portion, and said activation portion is sealingly guided in an intermittently pressurized activation bore.

* * * * *